US011019945B2

(12) United States Patent
Rosenberg et al.

(10) Patent No.: US 11,019,945 B2
(45) Date of Patent: Jun. 1, 2021

(54) SIDE SLEEPER PILLOWS HAVING VENTED EARHOLE FEATURES

(71) Applicants: Maxwell Pendelton Rosenberg, Phoenix, AZ (US); Justin James Leach, Phoenix, AZ (US)

(72) Inventors: Maxwell Pendelton Rosenberg, Phoenix, AZ (US); Justin James Leach, Phoenix, AZ (US)

(73) Assignee: Pomax, LLC, Phoenix, AZ (US)

( * ) Notice: Subject to any disclaimer, the term of this patent is extended or adjusted under 35 U.S.C. 154(b) by 0 days.

(21) Appl. No.: 16/529,812

(22) Filed: Aug. 2, 2019

(65) Prior Publication Data

US 2020/0037797 A1 Feb. 6, 2020

Related U.S. Application Data

(60) Provisional application No. 62/714,686, filed on Aug. 4, 2018.

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ... A47G 9/10; A47G 2009/1018; A47G 9/109
See application file for complete search history.

(56) References Cited

U.S. PATENT DOCUMENTS 3,124,812 A * 3/1964 Milton ..... A47G 9/10 5/638
4,550,458 A * 11/1985 Fiore ..... A47C 7/383 297/393
4,788,728 A * 12/1988 Lake ..... A47G 9/10 5/490
5,781,947 A * 7/1998 Sramek ..... A47G 9/109 5/636
5,848,448 A * 12/1998 Boyd ..... A47G 9/10 5/636
5,960,494 A * 10/1999 Gilliland ..... A61G 13/12 5/638
6,128,797 A * 10/2000 Shaffer ..... A47C 16/00 5/638
6,230,350 B1 * 5/2001 Goldstein ..... A47C 20/026 5/636
6,408,468 B1 * 6/2002 Comfort ..... A47G 9/10 5/498

(Continued)

*Primary Examiner* — Eric J Kurilla

(57) ABSTRACT

Embodiments of a side sleeper pillow are provided having vented earholes and other features for comfortably supporting the head of a sleeper when laying on his or her side. In various embodiments, the side sleeper pillow includes a pillow body having an outer periphery, a primary head support surface, and a first vented earhole feature. The first vented earhole feature includes, in turn, a first earhole having a first opening formed in the primary head support surface, as well as a first vent channel at least partially formed in the pillow body. The first vent channel extends from the first earhole to the outer periphery of the pillow body to enable fluid communication between an ambient environment and the first earhole when covered by the head of the sleeper.

19 Claims, 4 Drawing Sheets

(56) References Cited

U.S. PATENT DOCUMENTS 6,629,324 B1 * 10/2003 Shapiro ..... A47G 9/10 5/630
6,637,058 B1 * 10/2003 Lamb ..... A61G 13/12 5/638
6,745,418 B1 * 6/2004 Turner, Jr. ..... A47G 9/1027 5/638
D625,420 S * 10/2010 Sharps ..... D24/184
8,006,335 B1 * 8/2011 Andermann ..... A47G 9/1054 5/638
D669,725 S 10/2012 Blake
8,973,190 B2 * 3/2015 Oh ..... A47C 27/15 5/636
9,247,837 B1 2/2016 Blake
2003/0019007 A1 * 1/2003 Spencer ..... A47C 9/027 2/24
2006/0230538 A1 * 10/2006 Brown ..... A47G 27/0237 5/652
2007/0006382 A1 * 1/2007 Guez ..... A47G 9/10 5/638
2012/0117733 A1 * 5/2012 Chen ..... A47G 9/1009 5/652.1
2012/0180220 A1 * 7/2012 Popitz ..... A47G 9/1081 5/638
2013/0047339 A1 * 2/2013 Kim ..... A47G 9/109 5/637
2014/0208515 A1 * 7/2014 Sramek ..... A47G 9/109 5/640
2015/0040322 A1 * 2/2015 Cheng ..... A47G 9/1054 5/638
2015/0089743 A1 * 4/2015 Haworth ..... A47G 9/1036 5/640
2016/0058216 A1 * 3/2016 White ..... A47G 9/10 5/636
2017/0128307 A1 * 5/2017 Kim ..... A61H 1/008
2019/0069698 A1 * 3/2019 Lin ..... A47C 20/02
2019/0314232 A1 * 10/2019 Jerome-Miller ..... A47G 9/10
2020/0069088 A1 * 3/2020 Kim ..... A47G 9/10
2020/0155395 A1 * 5/2020 Popitz ..... A61F 5/56
2020/0214481 A1 * 7/2020 Sexton ..... A47G 9/1081

* cited by examiner

SIDE SLEEPER PILLOWS HAVING VENTED EARHOLE FEATURES

RELATED APPLICATION(S)

This application claims priority to provisional U.S. Patent Application Ser. No. 62/714,686, filed with the USPTO on Aug. 4, 2018, the entire contents of which are hereby incorporated by reference.

TECHNICAL FIELD

Embodiments of the present disclosure relate generally to orthopedic pillows and, more particularly, to orthopedic pillows having vented earholes and other features for comfortably supporting the head of a sleeper when laying on his or her side.

BACKGROUND

Orthopedic pillows, which include ergonomic designs tailored to support the head of a sleeper when resting in a particular sleep position, have gained widespread commercial adoption. The topology and other structural characteristics of such orthopedic pillows generally vary in relation to the particular sleep position the pillow is intended to support. In the case of a back sleeper pillow (that is, a pillow designed to support the head of a sleeper when laying on his or her back in a supine position), the pillow may include features encouraging a sleeper to maintain the sleeper's head in a neutral, forward-looking position during rest. Such features can include, for example, sloped ridges or contoured bumpers, which are located on opposing lateral sides of the pillow's frontside or principal head support surface. So too may a side sleeper pillow (that is, a pillow designed to support the head of a sleeper when laying on his or her side) include a principal head support surface bordered by sloped ridges or contoured bumpers. Additionally, certain side sleeper pillows include strategically-positioned depressions or openings, referred to herein as "earhole features" or simply "earholes," formed in the principal head support surface of the pillow. When properly positioned and dimensioned, such earholes may reduce the pressure applied against the ear region of a sleeper's head when contacting the principal head support surface of the pillow.

In the above-described manner, side sleeper pillows having earholes can enhance sleeper comfort by relieving pressure applied to and adjacent the ear region of a sleeper. This notwithstanding, there presently exist relatively few, if any commercially-available side sleeper pillows into which such earholes are incorporated. Further, even when incorporating earholes, existing side sleeper pillows may be limited in other various respects, as well, which minimize the effectiveness of the earholes and often detract from sleeper comfort Such limitations are further discussed below, as are examples of side sleeper pillows having vented earhole features and other unique structural features overcoming many, if not all of the limitations associated with conventional side sleeper pillows.

BRIEF DESCRIPTION OF THE DRAWINGS

At least one example of the present disclosure will hereinafter be described in conjunction with the following figures, wherein like numerals denote like elements, and.

DETAILED DESCRIPTION

Figure 1:
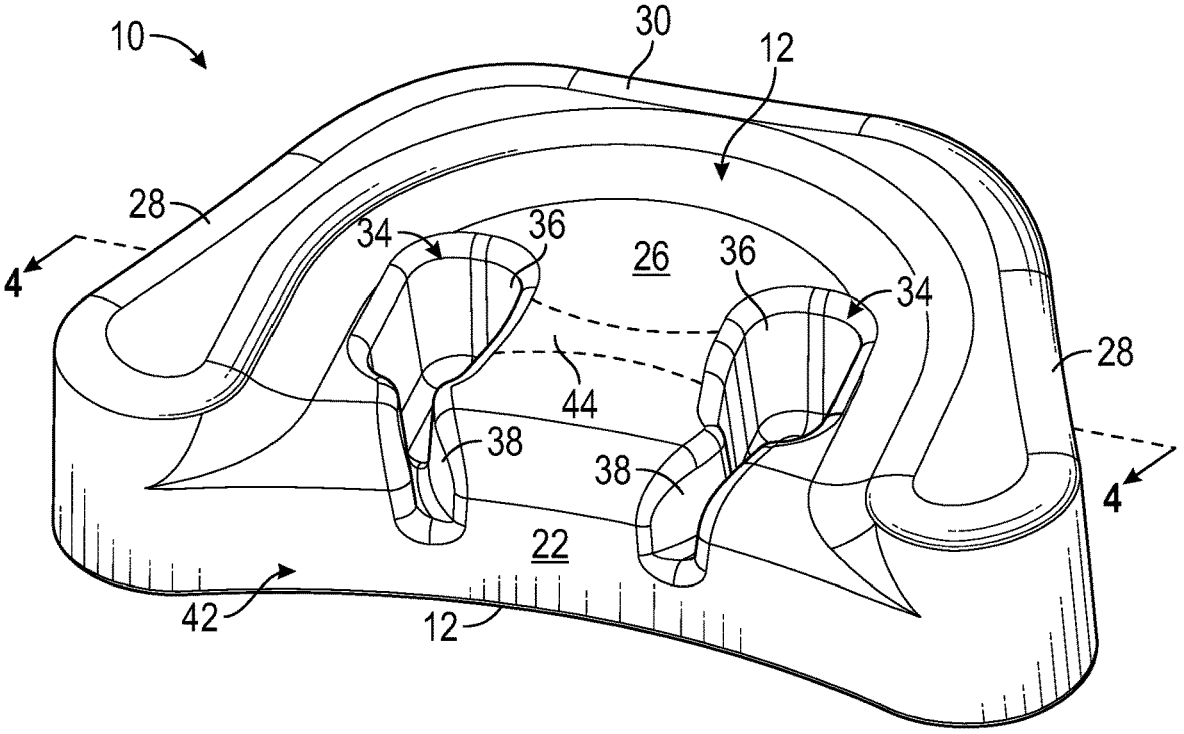
FIGS. 1, 2, 3, and 4 are isometric, front, rear, and cross-sectional views, respectively, of a side sleeper pillow incorporating vented earhole features and having a monolithic or single piece construction, as illustrated in accordance with an example embodiment of the present disclosure.

The following Detailed Description is merely example in nature and is not intended to limit the invention or the application and uses of the invention. Furthermore, there is no intention to be bound by any theory presented in the preceding Background or the following Detailed Description.

Definitions

The following definitions apply throughout this document Those terms not expressly defined here or elsewhere in this document are assigned their ordinary meaning in the relevant technical field.

Earhole—a depression, opening, or through-hole formed in a side sleeper pillow (defined below), breaching a principal head support surface of the pillow, and positioned to relieve pressure applied against or adjacent a sleeper's ear area when a side of the sleeper's head rests on the pillow.

Proximal peripheral surface—a peripheral surface of a side sleeper pillow located closest the trunk of a sleeper's body when the pillow is utilized in its intended orientation.

Side Sleeper Pillow—an orthopedic pillow designed to support the head of a sleeper when laying on his or her side such that the side of sleeper's head rests on the pillow.

Vented Earhole Feature—a feature including at least one earhole (defined above) and at least one vent channel, with the vent channel helping maintain fluid communication between the ambient environment and the earhole when covered by the head of a sleeper.

Overview

As previously indicated, side sleeper pillows incorporating earholes remain limited in various respects. For example, and without implying that such limitations have been recognized by others in the industry, existing earhole designs often suffer from poor ventilation or air circulation, particularly when the upper opening or mouth of an earhole is covered by the side of a sleeper's head. As a result, undesired fluctuations in pressure (e.g., due to a "cupping effect") can occur within a given earhole when covered by a sleeper's head, while the surrounding area of the pillow is compressed by the weight of the sleeper's head. Such pressure fluctuations may be perceptible to the sleeper through his or her eardrum and may consequently detract from sleeper comfort when using the side sleeper pillow. Additionally, poor air exchange between the ambient environment and the interior of a given earhole, when covered by a sleeper's head, can result in the occurrence of elevated local temperatures or "hot spots" adjacent the sleeper's ear region likewise detracting from sleeper comfort and degrading sleep quality. As a still further limitation, existing earhole designs may decrease the overall stability of a side sleeper pillow by, for example, lessening the ability of the pillow to fully support a sleeper's head in a uniform and stable manner.

To overcome the limitations above, side sleeper pillows are disclosed including vented earhole features, which enhance user comfort and providing improved head support during rest. In certain embodiments, the side sleeper pillow may include a single earhole feature having a single (e.g., centrally-located) earhole from which one or more vent channels extend. In various other embodiments, the below-described side sleeper pillow includes at least two vented earhole features, which are located on opposing sides of a midline plane of the pillow or pillow body; the term "midline plane," as appearing herein, referring to a plane containing the centerline (central vertical axis) of the side sleeper pillow and extending parallel to a longitudinal axis (rather than a lateral axis) of the pillow. Each vented earhole feature may include, in turn, at least one vent channel and an earhole in the form of a depression or cavity, which may or may not penetrate fully through the pillow body. The vent channel fluidly couples the interior of the earhole to the ambient environment in a manner permitting airflow exchange between the ambient environment and the earhole when the mouth or upper opening of the earhole is covered by a sleeper's head during rest. This, in turn, minimizes pressure fluctuations within the interior of the earhole during pillow usage, while maintaining ambient air circulation with the earhole to reduce heat accumulation and lower local temperatures adjacent the earhole. Sleeper comfort may be improved as a result. Further, in implementations in which the side sleeper pillow includes at least two vented earhole features, a coupling channel may connect the earholes to allow fluid communication between adjacent earholes thereby further reducing pressure fluctuations and promoting the exchange of cooling airflow.

In embodiments, the vent channel or channels of the side sleeper pillow may be shaped, dimensioned, and positioned to better maintain the structural integrity of the pillow body when compressed by a sleeper's head. To this end, the vent channels may be strategically positioned to minimize channel collapse when a sleeper rests his or her head on the principal head support surface of the pillow in the manner intended by the design of the pillow. For example, in implementations in which the vent channels extend from the earholes to intersect and, therefore, breach a proximal peripheral surface or wall of the pillow, a given vent channel may be formed at a position generally located underneath a sleeper's neck region when the sleeper's ear is positioned over the earhole to which the vent channel connects. Additionally or alternatively, the earholes may have an average depth greater than that of the vent channels and less than a thickness of the side sleeper pillow itself, as taken along a vertical axis at a location adjacent the earhole. Such a structural arrangement provides the above-described venting functionality, while further helping maintain the structural integrity of the pillow. In other embodiments, the dimensions of the vent channels and the earholes may vary; e.g., the earholes may be formed as through-holes penetrating fully through the main body of the pillow in certain implementations. The vent channels may also follow along curved paths in embodiments, as viewed from a planform or top-down view of the pillow; that is, a viewed along a centerline of the side sleeper pillow looking down on the primary head support surface of the pillow. As a more specific example, in implementations in which the pillow includes two vented earhole features and associated vent channels, the vent channels may follow curved paths converging toward one another and toward the midline plane of the pillow with increasing distance from the earholes.

Resistance to vent channel collapse is further enhanced, in embodiments, by constructing the side sleeper pillow from two or more separately-fabricated pieces. For example, in at least some implementations, the side sleeper pillow may be fabricated to include a base support piece, which defines a volumetric majority of the pillow; and a head contact pad, which is positioned over the base support piece and which defines, in whole or in substantial part, the principal head support surface of the pillow. In such implementations, a portion, if not the volumetric majority of vented earhole feature(s) may be formed in the base support piece. Comparatively, the openings or mouths of the earholes may be defined or formed in the head contact pad such that, when the head contact pad is properly positioned over an upper surface of the base support piece, the openings of the earholes align vertically with the lower portions of the earholes formed in the base support piece. Concurrently, the head contact pad may partially or wholly cover the vent channels, as seen from a top-down or planform view, to further deter vent channel collapse. The base support piece and the head contact pad are usefully, although non-essentially composed of different materials, such as a memory foams of varying densities. More specifically, the base support piece may be fabricated from a first material (e.g., a first, relatively stiff memory foam), while the head contact pad is produced from a second, less dense material (e.g., a second, softer memory foam) to further enhance sleeper comfort, while optimizing head support in embodiments. The foregoing advantages notwithstanding, the side sleeper pillow may have other constructions in further embodiments. For example, in other embodiments, the side sleeper pillow may be produced as a single or monolithic piece composed of a molded memory foam or other material.

Example embodiments of side sleeper pillows having vented earhole features will now be described in connection with FIGS. 1-9. Specifically, a first example embodiment of a side sleeper pillow having a monolithic or single piece construction is described below in conjunction with FIGS. 1-5, while a second example embodiment of a side sleeper pillow having a dual piece construction is described below in conjunction with FIGS. 6-9. The following description is provided by way of non-limiting example only. It is emphasized that numerous variations can be made to the example side sleeper pillows without departing from the scope of the invention, as set-forth in the appended claims. In this regard, while the example side sleeper pillows described below in conjunction with FIGS. 1-9 includes certain unique structural features in addition to one or more vented earholes features, such features need not be included in all embodiments of the side sleeper pillow.

Example Embodiments of Side Sleeper Pillows Having Vented Earholes

Figure 2:
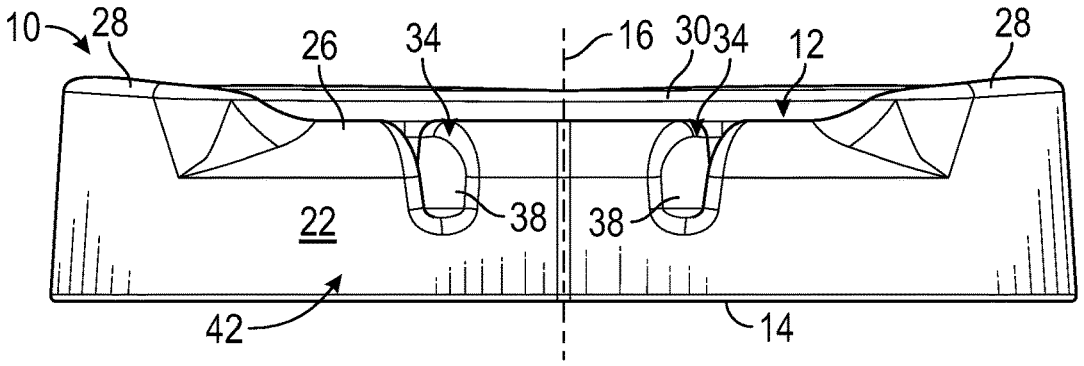
Figure 3:
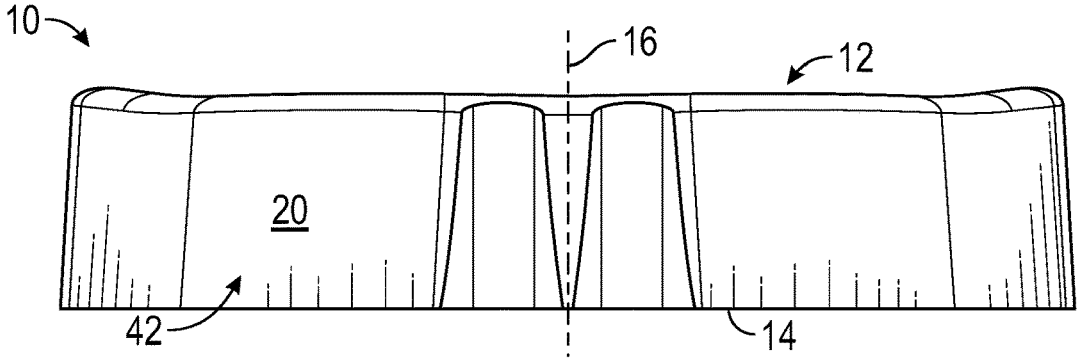
Figure 4:
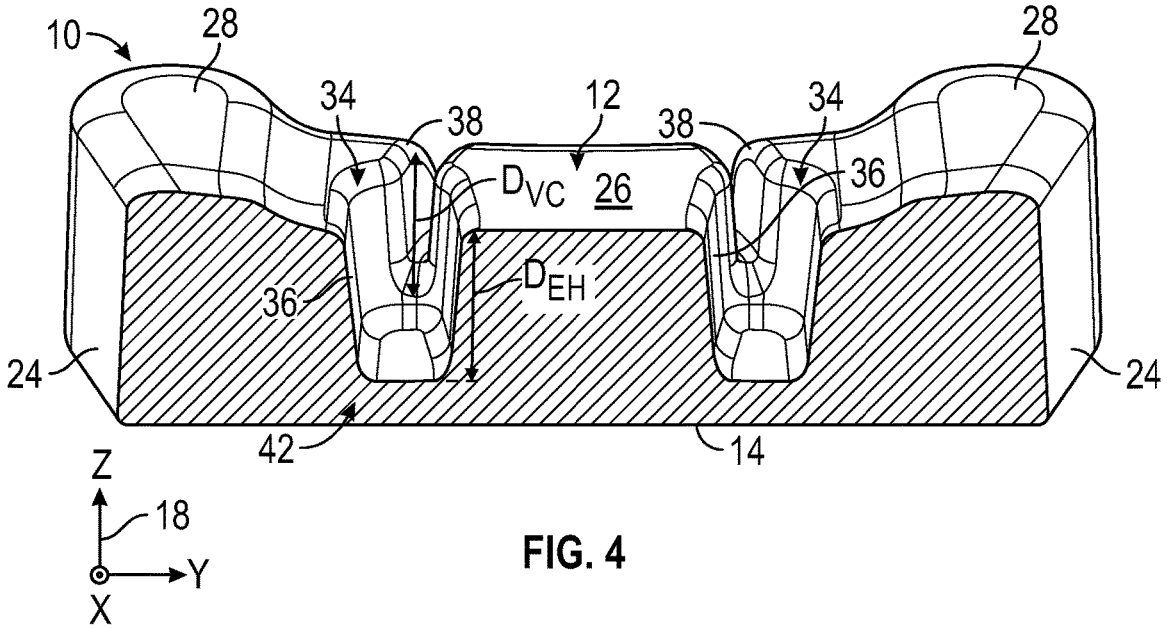

FIGS. 1, 2, 3, and 4 are isometric, front, rear, and cross-sectional views, respectively, of a side sleeper pillow 10, as illustrated in accordance with an example embodiment of the present disclosure. Side sleeper pillow 10 includes a pillow body having an upper surface or "frontside" 12 and an opposing lower surface or "backside" 14. Pillow frontside 12 and backside 14 are opposed or spaced along a vertical axis or centerline of side sleeper pillow 10. The centerline of pillow 10 is represented in FIGS. 2 and 3 by dashed line 16, which is parallel to the Z-axis of coordinate legend 18 in FIG. 4. Side sleeper pillow 10 further includes a distal peripheral wall or surface 20 (FIG. 3) and an opposing proximal peripheral wall or surface 22 (FIGS. 1 and 2). As appearing herein, the terms "distal" and "proximal" are defined relative to a sleeper's body position when properly using pillow 10 such that distal peripheral surface 20 is located further from the trunk of the sleeper's body than is proximal peripheral surface 22. Distal peripheral surface 20 and proximal peripheral surface 22 of side sleeper pillow 10 are spaced along the longitudinal axis of side sleeper pillow 10, which is perpendicular to centerline 16 (FIGS. 2 and 3) and parallel to the X-axis of coordinate legend 18 (FIG. 4). Side sleeper pillow 10 further includes laterally-opposed peripheral side surfaces 24, which are spaced along a lateral axis of side sleeper pillow 10 (perpendicular to centerline 16, perpendicular to the longitudinal axis of pillow 10, and parallel to the Y-axis of coordinate legend 18 shown in FIG. 4). Collectively, distal peripheral surface 20, proximal peripheral surface 22, and peripheral side surfaces 24 define an outer periphery 20, 22, 24 of pillow 10. The body of pillow 10 has a generally rounded trapezoidal planform shape or form factor in the illustrated example; however, various other pillow shapes are possible in further implementations.

Frontside 12 of side sleeper pillow 10 includes a primary head support surface 26, which serves as the principal source of support for a sleeper's head when using pillow 10. Primary head support surface 26 has a substantially planar or flat topology in the illustrated example. In further embodiments, primary head support surface 26 may have various other surface geometries or contours, such a gently concave surface contour, as well as a grid of cooling perforations or similar features. Side sleeper pillow 10 further includes two side rail portions 28 located on opposing sides of head support surface 26. Side rail portions 28 extend alongside head support surface 26 to flank surface 26, as taken along the pillow's longitudinal axis (again, parallel to the X-axis of coordinate legend 18 in FIG. 4 and perpendicular to centerline 16). Laterally-opposed side rail portions 28 further extend or project from the body of side sleeper pillow 10 in an upward direction, as taken along centerline 16 (FIGS. 2 and 3). Side sleeper pillow 10 also includes a distal bumper or rail portion 30, which flanks the distal edge of head support surface 26. Distal rail portion 30 may extend between and connect to side rail portion portions 28, as best shown in FIG. 1. Collectively, distal rail portion 30 and side rail portions 28 form a U-shaped or horseshoe-shaped ridge or raised rim 28, 30, which extends around three sides of head support surface 26 and which opens in a proximal direction towards the body of a sleeper when using pillow 10.

At least one vented earhole feature is formed in side sleeper pillow 10. In the illustrated embodiment, side sleeper pillow 10 includes two such vented earhole features 34, which are formed in a central portion of pillow 10 and which penetrate pillow frontside 12, while each extending into the body of pillow 10 by a certain depth. Each vented earhole feature 34 includes, in turn, an earhole 36 and at least one vent duct or channel 38, which connects to and extends outwardly from its respective earhole 36. Earholes 36 are partially defined by openings or mouths, which breach (and thus are exposed at) primary head support surface 26 and which may be contoured to have sloped or rounded edges. As labeled in FIG. 4, earholes 36 may each have a maximum (or average) depth $D_{EH}$, as measured along an axis parallel to centerline 16 (FIGS. 2 and 3) and the Z-axis of coordinate legend 18 (FIG. 4). In the illustrated example in which earholes 36 do not extend fully through the body of pillow 10, $D_{EH}$ is less than the thickness of pillow 10, as measured along centerline 16 (FIGS. 2-3) at a location between earholes 36. Earholes 36 may extend fully through the body of pillow 10 and may have various other contoured shapes in alternative embodiments. As a further possibility, side sleeper pillow 10 may be fabricated to include a greater or lesser number of vented earhole features 34 in other realizations. For example, in other embodiments, side sleeper pillow 10 may be produced to include a single vented earhole feature including a single, centrally-located earhole and one or more vent channels, which extend from the centrally-located earhole to an outer peripheral surface of pillow 10.

As indicated above, vent channels 38 extend from earholes 36 to outer periphery 20, 22, 24 of side sleeper pillow 10. In the illustrated example, vent channels 38 extend in a generally proximal direction and, therefore, in a direction away from distal rail portion 30. Further, as shown in FIGS. 1-4, vent channels 38 may extend to and, therefore, breach or penetrate proximal peripheral surface 22 of pillow 10 In other embodiments, vent channels 38 may breach a different surface or surfaces included in outer periphery 20, 22, 24 of side sleeper pillow 10. In this manner, vent channels 38 preserve fluid communication between an ambient environment and the respective interiors of earholes 36 even when the mouths or openings of earholes 36 (formed in head support surface 26) are covered by the head of the sleeper during pillow usage. The particular shape, dimensions, and disposition of vent channels 38 will vary among embodiments. However, by way of non-limiting example, vent channels 38 may each be formed to have an average or maximum depth $D_{VC}$ (labeled in FIG. 4), as measured along a vertical axis parallel to centerline 16 (FIGS. 2 and 3) and the Z-axis of coordinate legend 18 (FIG. 4).

In embodiments, earholes 36 and vent channels 38 may be dimensioned such that $D_{EH}$ exceeds $D_{VC}$ to provide a relatively deep earhole pocket, while better preserving the structural integrity of pillow 10 by limiting the depth of channels 38. Additionally or alternatively, the maximum depth ($D_{EH}$) of earholes 36 may be between 50% and 90% the thickness of the body of pillow 10, as taken along centerline 16 and/or as taken at a location adjacent either earhole 36. Comparatively, the maximum depth ($D_{VC}$) of vent channels 38 may be between 40% and 80% the thickness of the body of pillow 10 (again, as along centerline 16 and/or as taken at a location adjacent either earhole 36). In still other embodiments, $D_{EH}$ may be greater than the widths of the earholes 36, as taken along the lateral axis of pillow 10. Comparatively, the spacing between the inner edges of earholes 36 (that is, the edges of earholes 36 located closest centerline 16) may be greater than the width of either earhole 36, as taken along the lateral axis of pillow 10. In at least some embodiments, the respective depths of earholes 36 and vent channels 38 may be greater than or less than the aforementioned ranges. In various other implementations, the respective depths of earholes 36 and vent channels 38 may be greater than or less than the aforementioned ranges.

The structural integrity of side sleeper pillow 10 may be better preserved, despite the inclusion of earholes 36 and vent channels 38, by forming channels 38 to avoid transecting or dividing U-shaped rim 28, 30. In this regard, it can be seen in FIG. 1 that vent channels 38 extend from earholes 36 in a generally proximal direction to breach proximal peripheral surface 22 of pillow 10 and, therefore, extend in the same general direction as U-shaped rim 28, 30 opens. U-shaped rim 28, 30 (a thickened, outer portion of side sleeper pillow 10) is thereby left intact to provide, in essence, a supportive frame helping pillow 10 maintain its shape when partially compressed by the head of a sleeper. The curved geometry of vent channels 38 may also help prevent channel collapse, as may the strategic positioning of channels 38, as further discussed below.

As previously noted, vent channels 38 are shaped and dimensioned to allow substantially unimpeded fluid communication between the ambient environment and the interior of earholes 36 even when one or both of earholes 36 is covered by the head of the sleeper. This is further emphasized by FIG. 5, which is a top view of side sleeper pillow 10 conceptually separated into two halves (as indicated by double-headed arrow 40). An outline of a sleeper's head 42 is superimposed over each pillow half in FIG. 5 to illustrate the intended positions of a sleeper's head when utilizing side sleeper pillow 10. Earholes 36 are positioned such that at least one of earholes 36 is covered by the head of sleeper 42 when utilizing pillow 10, depending upon the particular direction in which the sleeper's faces. Earholes 36 may be sufficiently spacious to receive a sleeper's ear within the interior of the earhole to some degree; however, this is not necessary in all instances, providing that earholes 36 offer some degree of pressure relief to the sleeper's ears or the surrounding areas of the sleeper's head. The particular positioning or disposition of earholes 36 will vary amount embodiments. In the illustrated example, vented earhole features 34 are located on opposing sides of a midline plane extending along centerline 16 (FIGS. 2 and 3) and the longitudinal axis of side sleeper pillow 10 (corresponding to an X-Z plane corresponding to coordinate legend in FIG. 4). Further, vented earhole features 34 may be described as mirror opposites or bilaterally symmetrical about the midline plane of pillow 10 in the embodiment shown in FIGS. 1-5.

Figure 5:
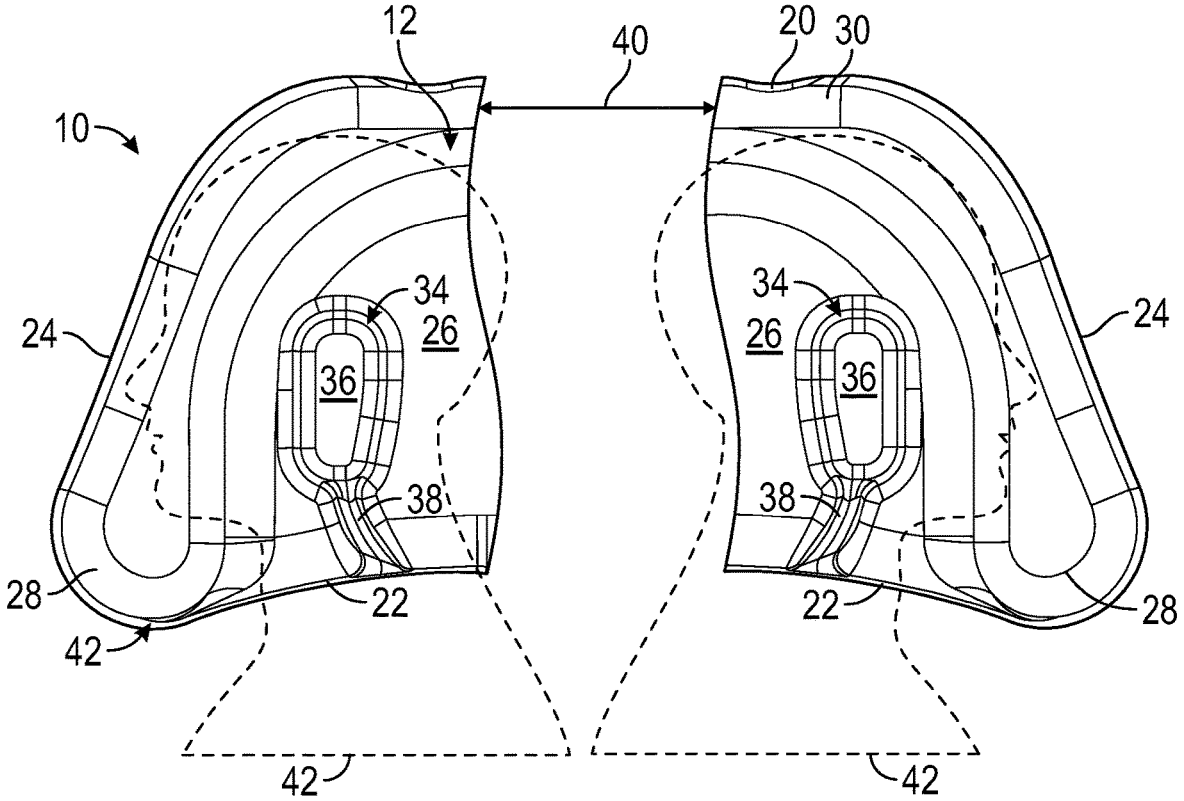
FIG. 5 is a top view of the side sleeper pillow shown in FIGS. 1-4 conceptually separated into two halves, with the outline of a sleeper's head superimposed over each pillow half to illustrate intended sleep positions when using the pillow.

Vent channels 38 may also be strategically positioned to prevent or deter channel collapse when pillow 10 supports the head of a sleeper, to provide additional pressure relief or cooling airflow to a sleeper's neck region, and/or to provide other benefits. In this regard, and as best shown in FIG. 5, vent channels 38 are usefully positioned such that, when a side sleeper rests his or her head on pillow 10 such that at least one of earholes 36 is covered by the sleeper's head, the vent channel 38 corresponding to the covered earhole 36 is generally located beneath the sleeper's neck region and, perhaps, adjacent the sleeper's outer shoulder. Such a channel positioning may effectively take advantage of a pocket of space in which less compression is applied due to the width of the sleeper's lower shoulder, which contacts the bed or other surface on which side sleeper pillow 10 is placed. This, in turn, may help deter collapse of vent channels 38 during usage of side sleeper pillow 10. As an additional benefit, vent channels 38 (particularly when formed as open channels or trenches, as shown in FIGS. 1-5) may help permit cooling airflow to a sleeper's neck region, reduce pressure applied to a sleeper's neck region, or both for further enhancements in sleeper comfort.

In the illustrated example, vent channels 38 are imparted with a generally curved geometry, as seen from a top-down or planform view looking downwardly on side sleeper pillow 10 along centerline 16 (shown in FIG. 5). Further, vent channels 38 may converge toward one another with increasing distance from earholes 36. Such a curved geometry may increase the strength of channels 38 to further deter channel collapse during pillow usage. In other embodiments, vent channels 38 may have a different positioning or shape, providing that channels 38 allow fluid communication between the ambient environment and respective interior of earholes 36 when covered by the head of a sleeper. More generally, side sleeper pillow 10 can include additional vent channels 38 in further embodiments; or, perhaps, one or more coupling channels extending between (and fluidly coupling) adjacent earholes 36. An example of such a coupling channel 44 is shown in phantom in FIG. 1. When provided in pillow 10, coupling channel 44 may further enhance fluid communication between the ambient environment and the interior of earholes 36 when one or both of earholes 36 is covered by a sleeper's head. In this manner, pressure fluctuations within earholes 36 can be minimized during pillow usage, while also promoting the circulation of cooling airflow into and out of earholes 36 to increase sleeper comfort.

With continued reference to FIGS. 1-5, side sleeper pillow 10 can be manufactured in various different manners and from varying materials. In many implementations, side sleeper pillow 10 will be partially or wholly composed of one or more pieces of molded memory foam. For example, in one embodiment, side sleeper pillow 10 may be produced as a single or monolithic piece composed of a memory foam formed utilizing a suitable molding process, such as pour molding. Notably, the design of pillow 10 allows the various features extending into or upwardly from frontside 12 (earholes 36, vent channels 38, primary head support surface 26, and raised rim 28, 30) to be formed utilizing one half of the mold; e.g., by forming the lower mold half of a pour-type mold to include shaped recesses, projections, or protrusions defining these features. Vent channels 38 are thus conveniently formed as open trenches exposed along head support surface 26 in corresponding embodiments, with such an approach simplifies and reduces the costs associated with manufacture of pillow 10. In other embodiments, only a portion of side sleeper pillow 10 may be composed of a memory foam, such as the portions of pillow 10 principally contacted by a sleeper's head during proper usage of pillow 10, while other portions of side sleeper pillow 10 are produced from a disparate material, such as a polymer-based material (e.g., latex), a silicone gel, or the like. As a still further possibility, side sleeper pillow 10 may be assembled from multiple pieces (e.g., molded foam pieces) of varying densities, as discussed more fully below in conjunction with FIGS. 6-9. Finally, if so desired, one or more form-fitting covers can be disposed over side sleeper pillow 10 after manufacture thereof. When provided, such cover or covers may or may not be removable by the sleeper.

Figure 6:
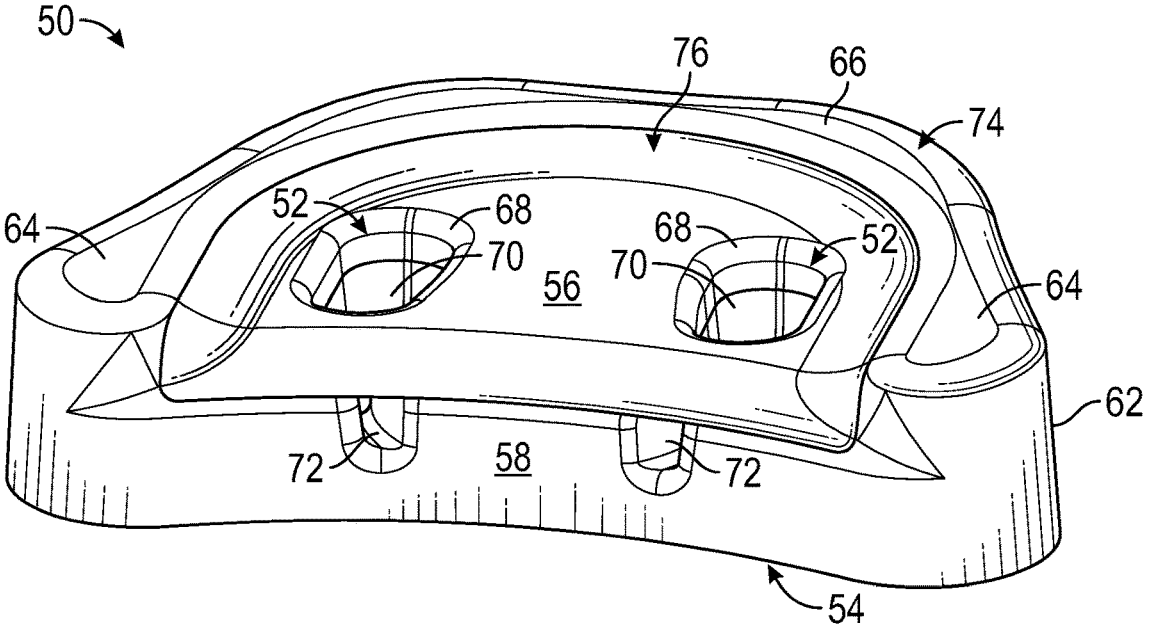
FIGS. 6 and 7 are isometric and cross-sectional views, respectively, of a side sleeper pillow containing vented earhole features and having a dual piece construction, as illustrated in accordance with a second example embodiment.
Figure 7:
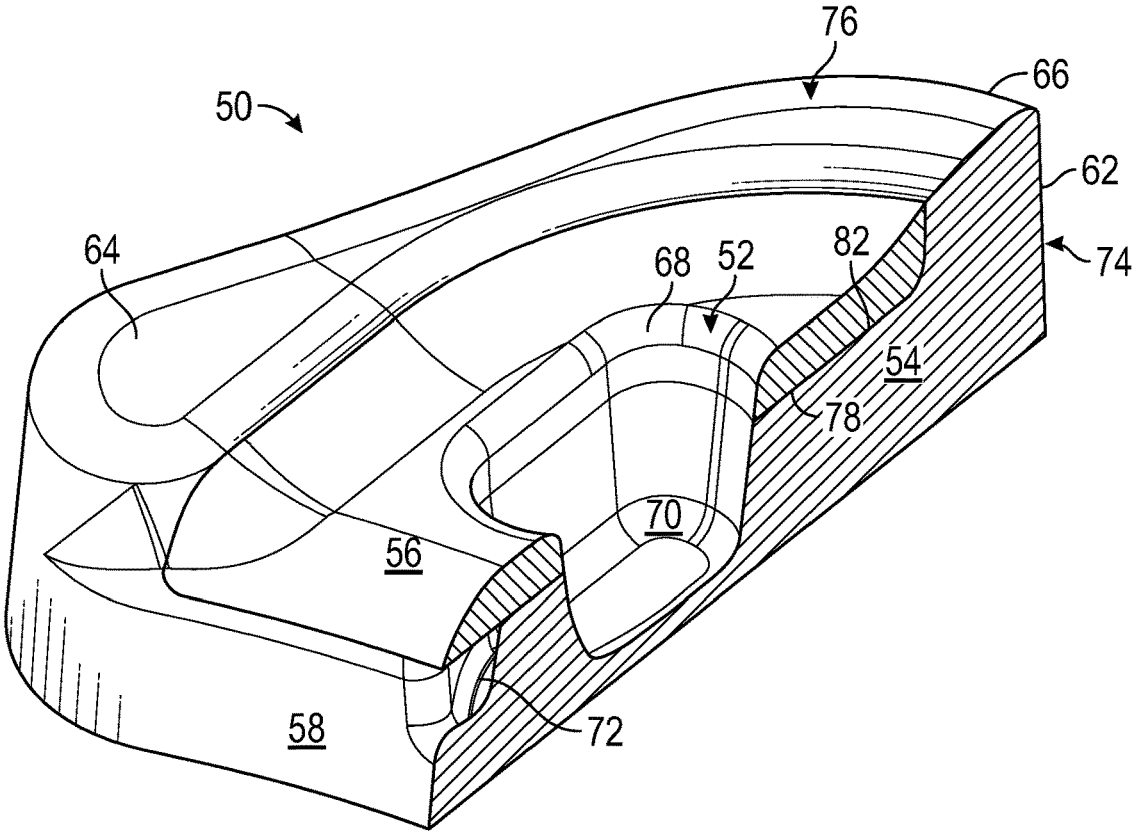

Turning now to FIGS. 6 and 7, a side sleeper pillow 50 having a dual piece construction and containing vented earhole features 52 is further depicted in accordance with a second example embodiment of the present disclosure. In many respects, side sleeper pillow 50 is similar to side sleeper pillow 10 described above in conjunction with FIGS. 1-5. For example, side sleeper pillow 50 again includes a pillow body 54, a principal head support surface 56, and an outer periphery 58, 60, 62. Outer periphery 58, 60, 62 is defined by a proximal peripheral surface 58, a distal peripheral surface 60, and laterally-opposed side surfaces 62 of pillow 50. A U-shaped rim 64, 66 extends upwardly from pillow body 54 relative to principal head support surface 56. As was previously the case, U-shaped rim 64, 66 includes laterally-opposed side rail portions 64 and a distal rail portion 66. Side rail portions 64 and distal rail portion 66 physically connect or join to impart rim 64, 66 with a horseshoe or U-shaped geometry opening in a proximal direction toward the body of a sleeper when utilizing pillow 50. In other embodiments, pillow 50 may include only laterally-opposed side rail portion portions 64 or may lack U-shaped rim 64, 66.

Similar to vented earholes features 34 of side sleeper pillow 10 (FIGS. 1-5), vented earhole features 52 of side sleeper pillow 50 (FIGS. 6-7) each include an earhole 68, 70 and at least one vent channel 72. Earholes 68, 70 each include, in turn, an opening formed in principal head support surface 56 and positioned to receive or to be covered by the ear area of a sleeper when using pillow 50. Vent channels 72 extend from earholes 68, 70 to proximal an outer peripheral surface of side sleeper pillow 50. Specifically, vent channels 72 extend to and breach outer peripheral surface 58 of pillow 50 to allow fluid communication between the ambient environment and earholes 68, 70 when covered by the head of a sleeper. As previously indicated, earholes 68, 70 may or may not fully penetrate pillow body 54 in a vertical direction; that is, along a direction parallel with centerline 16. Earholes 68, 70 may be formed to have an average depth greater than the respective average depths of vent channels 72 in embodiments. Finally, vent channels 72 may follow curved paths, as seen from a top-down or planform view. Additionally, vent channels 72 toward one another with increasing distance from earholes 68, 70. Each vent channel 72 may also be positioned beneath the neck region of a sleeper when properly utilizing pillow 50 such that the sleeper's ear area contacts or is received by one of earholes 68, 70, as previously described.

Figure 8:
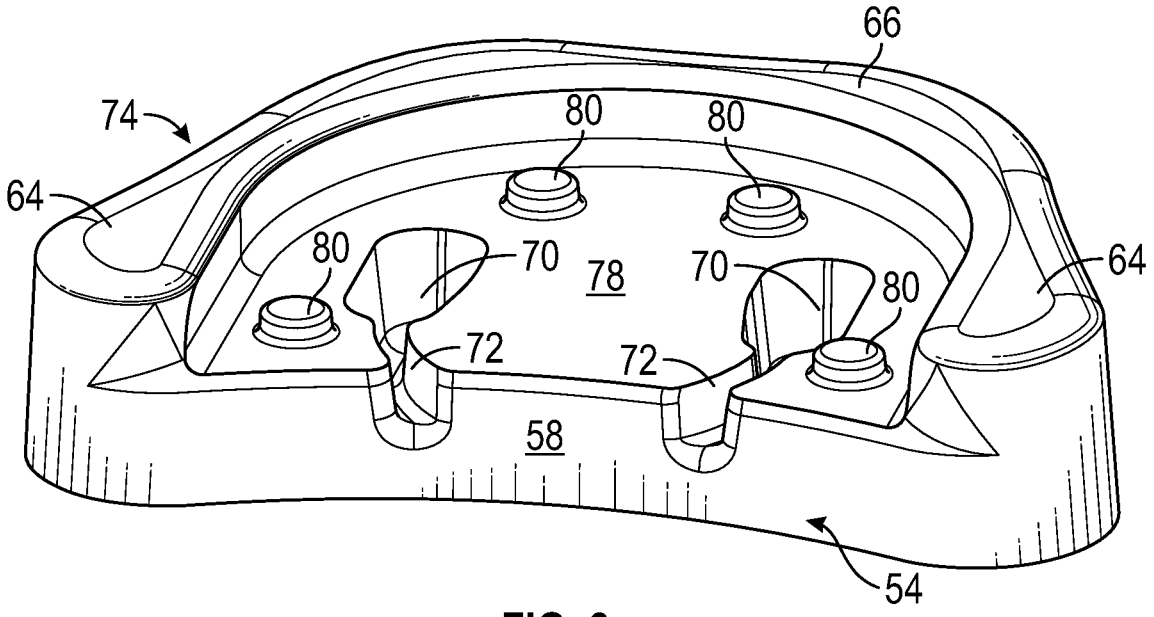
FIG. 8 is an isometric view of the base support piece included in the side sleeper pillow of FIGS. 6 and 7, as illustrated with the head contact pad removed.

In contrast to side sleeper pillow 10 (FIGS. 1-5), side sleeper pillow 50 is produced from multiple discretely or separately fabricated pieces, which are assembled to yield the final pillow structure. Specifically, side sleeper pillow 50 is assembled from two separately-fabricated pieces or parts: (i) a first piece referred to herein as a "base support piece 74," and (ii) a second piece referred to herein as "head contact pad 76." Addressing first base support piece 74, this component of pillow 50 is further shown in isolation in FIG. 8. Referring collectively to FIGS. 6-8, base support piece 74 may constitute the volumetric bulk or majority of pillow 10 when assembled. Vent channels 72 may be formed in base support piece 74, whether in part or in their entirety; e.g., in the illustrated example, vent channels 72 are fully formed in base support piece 74 such that channels 72 are located vertically below or beneath head contact pad 76. Similarly, lower portions 70 of earholes 68, 70 may be formed in base support piece 74. In the illustrated example, lower portions 70 constitute the volumetric majority of earholes 68, 70; however, this need not be the case in all embodiments. Base support piece 74 further includes an upper principal surface 78 from which a plurality of locating features 80 project Locating features 80 assume the form of rounded posts or localized protuberances in the illustrated embodiment and are consequently referred to hereafter as "locating posts 80." In other embodiments, base support piece 74 may include other locating features; location of head contact pad 76 may be accomplished by a close mating fit or registration of pad 76 with raised rim 64, 66; or base support piece 74 may lack such locating features.

Figure 9:
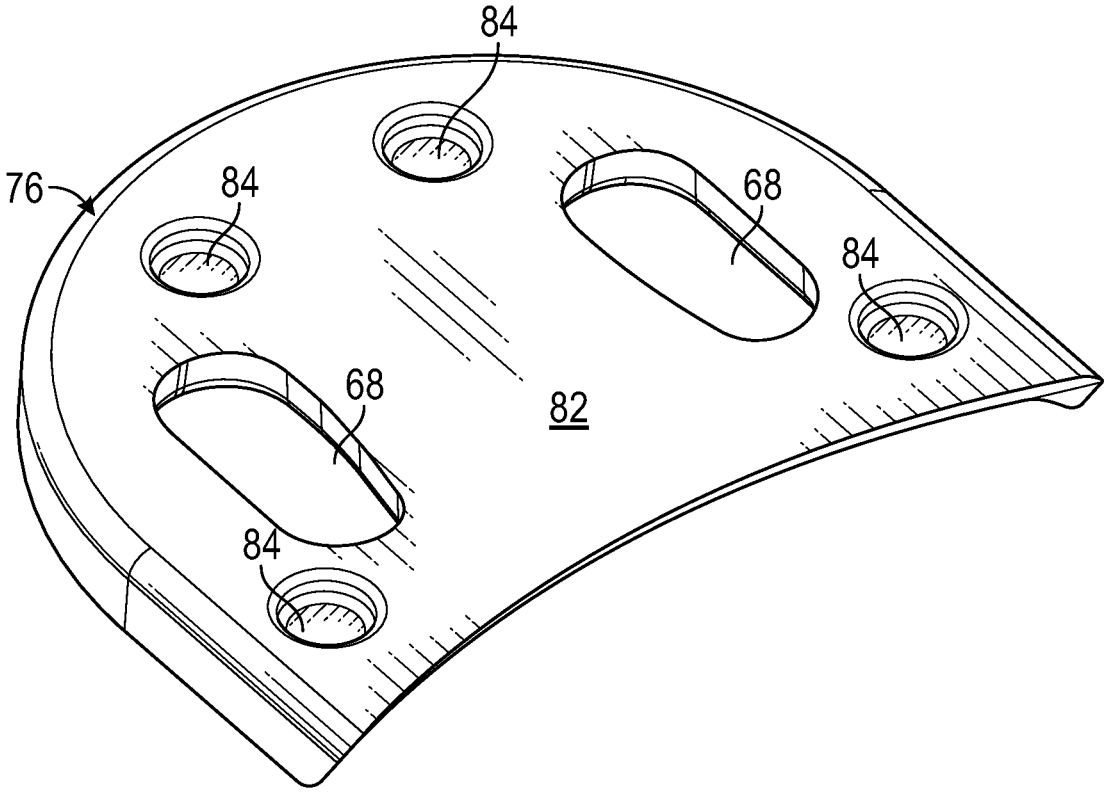
FIG. 9 is a bottom isometric view of the head contact pad included in the example side sleeper pillow of FIGS. 6 and 7, as shown in isolation.

Advancing to FIG. 9, the underside of head contact pad 76 is shown in isolation. Here, it can be seen that head contact pad 76 includes a lower principal surface 82 in which a plurality of locating features 84 are formed. Here, locating features 84 assume the form of depressions or cavities for receiving locating posts 80 therein and are thus referred to hereafter as "locating depressions 84." The number and positioning of locating depressions 84 provided on lower principal surface 82 of head contact pad 76 matches or corresponds to the number and positioning of locating posts 80 provided on upper principal surface 78 of base support piece 74. Further, upper portions 68 of earholes 68, 70 (and therefore the mouths or openings of earholes 68, 70) are further formed in (and extend vertically through) head contact pad 76. As shown most clearly in FIGS. 6 and 7, upper portions 68 of earholes 68, 70 vertically align with lower portions 70 when head contact pad 76 is properly positioned over base support piece 74 to form earholes 68, 70. Concurrently, head contact pad 76 covers a majority, if not the substantial entirety of vent channels 72, as seen looking downwardly on pillow 40 along its centerline, to deter the obstruction or collapse of vent channels 72 during pillow usage. In still other embodiments, the underside of head contact pad 76 may be imparted with protrusions or raised features, which engage into upper portions or regions of vent channels 72 (without filling the interior of channels 72) to further resist channel collapse when a sleeper rests his or her head on side sleeper pillow 50.

Base support piece 74 and head contact pad 76 are usefully, although non-essentially composed of different materials. For example, in various embodiments, base support piece 74 can be composed of a first material having an increased firmness, a greater density, or decreased flexibility as compared to a second material from which head contact pad 76 is produced. By fabricating head contact pad 76 from a relatively soft material, such as a first molded memory foam having a density less than the density of the material (e.g., a second molded memory foam having a higher stiffness) from which base support piece 74 is produced, several advantages may be realized. First, sleeper comfort may be improved by fabricating head contact pad 76 and, therefore, principal head support surface 56 from a relatively soft material. Second, by fabricating base support piece 74 from a stiffer or more dense material, the overall structure integrity of pillow 50 may be increased, while decreasing the propensity of vent channels 72 to collapse inwardly during pillow usage. Base support piece 74 and head contact pad 76 may be adhesively joined when assembled or, instead, may be maintained in their desired positions by engagement of locating features 80, 84 and/or of head contact pad 76 with the inner peripheral edge of U-shaped rim 64, 66; e.g., a slight dovetail interface may be provided in which a lower peripheral edge of head contact pad 76 registers into a slight recess provided beneath U-shaped rime 64, 66. Further, in certain embodiments, base support piece 74 and head contact pad 76 may also be maintained in mating engagement by a form-fitting cover (not shown) positioned over side sleeper pillow 50.

Enumerated Examples of the Side Sleeper Pillow

The following examples of the side sleeper pillow are further provided and numbered for ease of reference.

1. Embodiments of a side sleeper pillow utilized to support the head of a sleeper in a side sleeping position. In certain embodiments, the side sleeper pillow includes a pillow body having an outer periphery, a thickness taken along a centerline of the side sleeper pillow, a width taken along a lateral axis perpendicular to the centerline, and a length taken along a longitudinal axis orthogonal to the centerline and lateral axis. The side sleeper pillow further includes a first vented earhole features and a primary head support surface, which is provided on the pillow body. The first vented earhole feature includes, in turn: (i) a first earhole extending into the pillow body and including a first opening formed in the primary head support surface; and (ii) a first vent channel at least partially formed in the pillow body. The first vent channel extends from the first earhole to the outer periphery of the pillow body to enable fluid communication between an ambient environment and the first earhole when covered by the head of the sleeper.

2. The side sleeper pillow of example 1 wherein the outer periphery of the pillow body includes a distal peripheral surface and a proximal peripheral surface, which is located opposite the distal peripheral surface as taken along the longitudinal axis. The first vent channel extends to and penetrates or breaches the proximal peripheral surface of the pillow body.

3. The side sleeper pillow of example 1 wherein the first earhole has an average or maximum depth $D_{EH}$ as taken along an axis parallel to the centerline, wherein the first vent channel has an average or maximum depth $D_{VC}$ as taken along an axis parallel to the centerline, and wherein $D_{EH}>D_{VC}$.

4. The side sleeper pillow of example 1 wherein the average depth $D_{EH}$ of the first earhole is between 50% and 90% of the thickness of the pillow body, as taken along the centerline.

5. The side sleeper pillow of example 1 wherein the first vent channel follows a curved path, as viewed looking downwardly on the primary head support surface along the centerline.

6. The side sleeper pillow of example 5 wherein the first vent channel bends toward a midline plane when moving from the earhole toward an outer peripheral surface of the pillow body, the midline plane encompassing the centerline and the longitudinal axis.

7. The side sleeper pillow of example 1 further including a second vented earhole feature. The second vented earhole feature includes, in turn: (i) a second earhole extending into the pillow body and having a second opening formed in the primary head support surface; and (ii) a second vent channel at least partially formed in the pillow body, the second channel extending from the second earhole to the outer periphery of the pillow body.

8. The side sleeper pillow of example 7 wherein the first earhole has a first width as taken along the lateral axis, wherein the second earhole has a second width as taken along the lateral axis, wherein the first and second earholes are separated by a lateral spacing along the lateral axis, and wherein the lateral spacing exceeds the first width and exceeds the second width.

9. The side sleeper pillow of example 7 wherein the first and second vented earhole features are located on opposing sides of a midline plane, which encompasses (contains) the centerline and longitudinal axis.

10. The side sleeper pillow of example 9 wherein the first and second vented earhole features are bilaterally symmetrical about the midline plane.

11. The side sleeper pillow of example 7 wherein the first and second vent channels converge with increasing distance from the first and second earholes.

12. The side sleeper pillow of example 1 wherein the pillow body includes a base support piece; wherein the side sleeper pillow further includes a head contact pad matingly positioned over an upper surface of the base support piece; and wherein the primary head support surface is defined, at least in principal part, by the head contact pad.

13. The side sleeper pillow of claim 12 wherein an upper portion of the first earhole is formed in the head contact pad and a lower portion of the first earhole is formed in the base support piece.

14. The side sleeper pillow of example 12 wherein the head contact pad covers at least a majority of the first vent channel, as viewed looking downwardly on the side sleeper pillow along the centerline.

15. The side sleeper pillow of example 12 wherein the head contact pad is composed of a first material having a first density, and wherein the base support piece is composed of a second material having a second density greater than the first density.

CONCLUSION

The foregoing has described embodiments of a side sleeper pillow including vented earhole features and other unique structural features enhancing sleeper comfort during pillow usage. As described above, the vented earhole features may include earholes, which penetrate the principal head support surface of the pillow and which connect to vent channels further formed in the pillow. The vent channels extend from the earholes to an outer peripheral wall or surface, such as a proximal peripheral surface, of the pillow to enhance fluid communication between the ambient environment and the interior of the earholes, even when covered by the head of the sleeper. Venting of the earholes in this manner favorably reduces the accumulation of pressure when a particular earhole is covered by a sleeper's head, while improving circulation of cooling airflow to the interior of the earholes. In embodiments, the earholes are usefully positioned in a strategic manner to minimize covering or collapse of the channels when a sleeper rests his or her head upon the side sleeper pillow, while also ensuring that the pillow can be manufactured in a relatively straightforward and cost effective manner. Such criteria can be satisfied, in certain implementations, by forming the vent channels as trenches opening toward the head support surface; to have a curved geometry as seen from a top-down perspective; to have a maximum depth less than the maximum depths of the earholes; to converge toward the pillow midline with increasing proximity to the pillow's proximal peripheral surface or wall; or any combination of the foregoing characteristics. In this manner, the structural integrity of the side sleeper pillow may be better maintained despite the provision of the vented earhole feature(s) to better support a sleeper's head in a stable and uniform manner.

While at least one example embodiment has been presented in the foregoing Detailed Description, it should be appreciated that a vast number of variations exist. It should also be appreciated that the example embodiment or example embodiments are only examples, and are not intended to limit the scope, applicability, or configuration of the invention in any way. Rather, the foregoing Detailed Description will provide those skilled in the art with a convenient road map for implementing an example embodiment of the invention. It being understood that various changes can be made in the function and arrangement of elements described in an example embodiment without departing from the scope of the invention as set-forth in the appended claims.

What is claimed is:

1. A side sleeper pillow utilized to support the head of a sleeper in a side sleeping position, the side sleeper pillow comprising:

a pillow body having an outer periphery, a thickness taken along a centerline of the side sleeper pillow, a width taken along a lateral axis perpendicular to the centerline, and a length taken along a longitudinal axis orthogonal to the centerline and the lateral axis;

a primary head support surface on the pillow body; and a first vented earhole feature, comprising:

a first earhole extending into the pillow body and including a first opening formed in the primary head support surface; and a first vent channel at least partially formed in the pillow body, the first vent channel extending from the first earhole to the outer periphery of the pillow body to enable fluid communication between an ambient environment and the first earhole when covered by the head of the sleeper, the first vent channel following a curved path viewed looking downwardly on the primary head support surface along the centerline, the curved path bending away from or toward a midline plane when moving from the earhole toward an outer peripheral surface of the pillow body, the midline plane encompassing the centerline and the longitudinal axis.

2. The side sleeper pillow of claim 1 wherein the first earhole has a maximum width greater than a maximum width of the first vent channel taken along the lateral axis; and wherein the maximum width of the first vent channel is less than a depth of the first vent channel taken along axis parallel to the centerline.

3. A side sleeper pillow utilized to support the head of a sleeper in a side sleeping position, the side sleeper pillow comprising:

a pillow body having an outer periphery, a thickness taken along a centerline of the side sleeper pillow, a width taken along a lateral axis perpendicular to the centerline, and a length taken along a longitudinal axis orthogonal to the centerline and the lateral axis;

a primary head support surface on the pillow body; and a first vented earhole feature, comprising:

a first earhole extending into the pillow body and including a first opening formed in the primary head support surface; and a first vent channel at least partially formed in the pillow body, the first vent channel extending from the first earhole to the outer periphery of the pillow body to enable fluid communication between an ambient environment and the first earhole when covered by the head of the sleeper, a second vented earhole feature, comprising:

a second earhole extending into the pillow body and having a second opening formed in the primary head support surface; and a second vent channel at least partially formed in the pillow body, the second channel extending from the second earhole to the outer periphery of the pillow body, the first vent channel and the second vent channel converging with increasing distance from the first and second earholes.

4. The side sleeper pillow of claim 3 wherein the outer periphery of the pillow body comprises:

a distal peripheral surface; and a proximal peripheral surface located opposite the distal peripheral surface as taken along the longitudinal axis, the first vent channel penetrating the proximal peripheral surface of the pillow body.

5. The side sleeper pillow of claim 3 wherein the first earhole has a maximum depth ($D_{EH}$) as taken along an axis parallel to the centerline;

wherein the first vent channel has a maximum depth ($D_{vc}$) as taken along an axis parallel to the centerline; and wherein $D_{EH}>D_{vc}$.

6. The side sleeper pillow of claim 3 wherein the maximum depth ($D_{EH}$) of the first earhole is between 50% and 90% the thickness of the pillow body, as taken along the centerline.

7. The side sleeper pillow of claim 3 wherein the first vent channel follows a curved path, as viewed looking downwardly on the primary head support surface along the centerline.

8. The side sleeper pillow of claim 3 further comprising a second vented earhole feature, the second vented earhole feature comprising:

a second earhole extending into the pillow body and having a second opening formed in the primary head support surface; and a second vent channel at least partially formed in the pillow body, the second channel extending from the second earhole to the outer periphery of the pillow body.

9. The side sleeper pillow of claim 8 wherein the first earhole has a first width as taken along the lateral axis;

wherein the second earhole has a second width as taken along the lateral axis;

wherein the first and second earholes are separated by a lateral spacing along the lateral axis; and wherein the lateral spacing exceeds the first width and exceeds the second width.

10. The side sleeper pillow of claim 8 wherein the first and second vented earhole features are located on opposing sides of a midline plane, which encompasses the centerline and longitudinal axis.

11. The side sleeper pillow of claim 10 wherein the first and second vented earhole features are bilaterally symmetrical about the midline plane.

12. The side sleeper pillow of claim 3 wherein the pillow body comprises a base support piece;

wherein the side sleeper pillow further comprises a head contact pad matingly positioned over an upper surface of the base support piece; and wherein the primary head support surface is defined, at least in principal part, by the head contact pad.

13. The side sleeper pillow of claim 12 wherein an upper portion of the first earhole is formed in the head contact pad and a lower portion of the first earhole is formed in the base support piece.

14. The side sleeper pillow of claim 12 wherein the head contact pad covers at least a majority of the first vent channel, as viewed looking downwardly on the side sleeper pillow along the centerline.

15. The side sleeper pillow of claim 12 wherein the head contact pad is composed of a first material having a first density; and wherein the base support piece is composed of a second material having a second density greater than the first density.

16. A side sleeper pillow utilized to support the head of a sleeper in a side sleeping position, the side sleeper pillow comprising:

a pillow body having a proximal peripheral surface, a distal peripheral surface spaced from the proximal peripheral surface along a longitudinal axis of the pillow, a frontside, and a backside spaced from the frontside along a centerline;

a primary head support surface provided on the frontside of the pillow body;

a first vented earhole feature formed in the pillow body, exposed at the primary head support surface, and located on a first side of a midline plane containing the centerline and the longitudinal axis; and a second vented earhole feature formed in the pillow body, exposed at the primary head support surface, and located on a second, opposing side of the midline plane;

wherein the first and second vented earhole features each comprise an earhole and a vent channel extending from the earhole to an outer periphery of the pillow body, the vent channel having a maximum width less than a maximum width of the earhole and having a depth greater than the maximum width of the earhole.

17. The side sleeper pillow of claim 16 wherein the first vented earhole feature and the second vented earhole feature are oriented as mirror opposites taken about the midplane.

18. The side sleeper pillow of claim 16 further comprising a U-shaped distal head rail portion extending alongside a distal edge of the head support surface, the vent channel of each of the vented earhole features extending in a direction substantially opposite the distal head rail portion and toward a body of the sleeper when using the side sleeper pillow.

19. The side sleeper pillow of claim 16 wherein the side sleeper pillow comprises a single molded piece; and wherein the vent channels comprise open trenches exposed along the primary head support surface.

* * * * *